US006667448B2

(12) United States Patent
Schaefer

(10) Patent No.: US 6,667,448 B2
(45) Date of Patent: Dec. 23, 2003

(54) CONTACT ELEMENT

(75) Inventor: Joerg Schaefer, Rheinbach (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/300,395

(22) Filed: Nov. 20, 2002

(65) Prior Publication Data

US 2003/0070905 A1 Apr. 17, 2003

Related U.S. Application Data

(63) Continuation of application No. 09/589,308, filed on Jun. 7, 2000.

(51) Int. Cl.[7] ..... H01H 15/00
(52) U.S. Cl. ..... 200/16 A; 200/243
(58) Field of Search ..... 200/16 A, 243, 200/280

(56) References Cited

U.S. PATENT DOCUMENTS 3,188,405 A * 6/1965 Scheib, Jr. ..... 200/16 A
3,514,554 A * 5/1970 Boysen ..... 200/16 R
3,641,287 A * 2/1972 Hughes ..... 200/16 A
3,892,934 A * 7/1975 Richards et al. ..... 200/288
4,006,322 A * 2/1977 Gallatin et al. ..... 200/16 A
4,277,662 A * 7/1981 Lewandowski ..... 200/242
4,306,123 A * 12/1981 Taylor ..... 200/16 A
6,198,058 B1 * 3/2001 Graninger et al. ..... 200/50.02

* cited by examiner

*Primary Examiner*—Michael Friedhofer
(74) *Attorney, Agent, or Firm*—Davidson, Davidson & Kappel, LLC

(57) ABSTRACT

A contact element for an electrical switching apparatus includes two electrical contacts for electrical conductors. A contact bridge is disposed in an actuating tappet for connecting and interrupting an electrical connection between the two electrical contacts. The actuating tappet is movable in an axial direction in a casing. The actuating tappet may be disposed in the casing in two positions so that in one position the actuating tappet is rotated 180 degrees about a transverse axis of the actuating tappet relative to the other position so as to be operable in opposite axial directions and enable the switching apparatus to be useable for both front side and rear side mounting.

12 Claims, 6 Drawing Sheets

CONTACT ELEMENT

CROSS REFERENCE TO RELATED APPLICATION

This application is a continuation of U.S. application Ser. No. 09/589,308, filed Jun. 7, 2000.

BACKGROUND OF THE INVENTION

1. Field of the Invention

The invention relates to a contact element for an electrical switching apparatus.

2. Brief Description of the Background of the Invention Including Prior Art

Such contact elements are already known, wherein different constructions of actuating tappets are employed for the different switching functions 'opening' and 'closing'. It is here a disadvantage to have a high number of individual parts to be fabricated and the requiring assembly as well as the expensive assembly mounting of the contact elements.

It is an object of the present invention to furnish a contact element of the initially described kind, which avoids the recited disadvantages.

It is a further object of the invention to furnish a versatile contact element with a low number or required parts.

It is yet another object of the invention to construct a contact switch such that it can be assembled both as a normally open switch and as a normally closed switch.

These and other objects and advantages of the present invention will become evident from the description which follows.

BRIEF DESCRIPTION OF THE INVENTION

The present invention provides a contact element for electrical switching apparatus having a casing with a basis part and cover part, two electrical fixed contacts having connections for electrical conductors and disposed inside of the casing, and an actuating tappet supported over a first spring means in the casing and movable in an axial direction for receiving of a contact bridge, wherein the contact bridge serves for connecting or, respectively; interrupting the electrical connection between the two fixed contacts, wherein the actuating tappet is constructed such that the contact bridge can be disposed in two different positions having a distance from each other at the actuating tappet.

According to a further embodiment of the contact element, the casing of the contact element and by adaptation thereto, the actuating tappet is constructed advantageously such that the actuating tappet is also mountable having an incorporated position rotated by 180 degrees around a perpendicular axis relative to a longitudinal axis of the actuating tappet.

The invention comprises furthermore electrical switching apparatus such as in particular manually actuable input apparatus, for example pressure switches or rotary switches, wherein the contact device is formed by a contact element according to the present invention. Furthermore the present invention also comprises power switching apparatus such as contactors, control gates, power switches, and power circuit breakers or the like, wherein then the auxiliary switch is formed by contact elements according to the present invention.

Further details and advantages of the invention result from the following embodiment illustrated by way of the FIGS.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
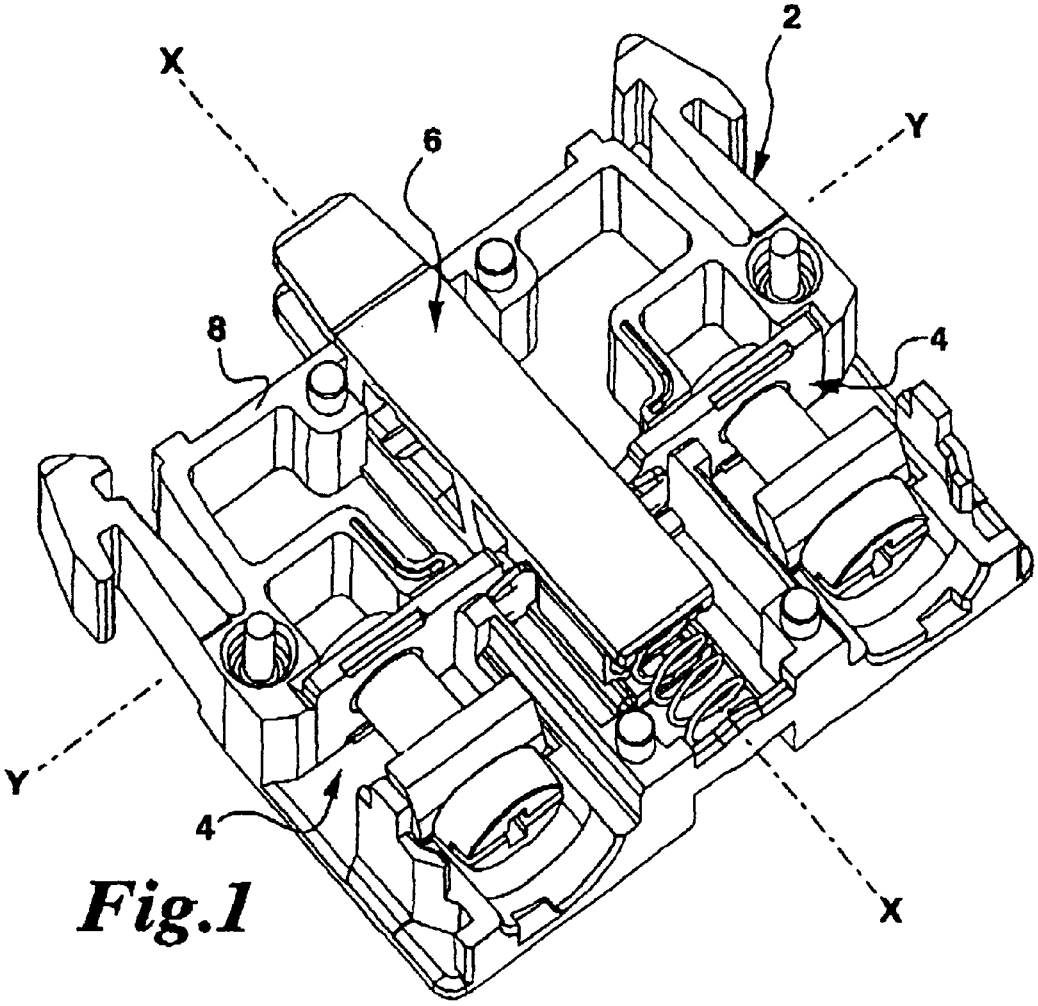
FIG. 1 is a schematic perspective view of a first embodiment of the invention contact element without cover part as an opening switch for front side mounting.

FIG. 1 shows the contact element according to the present invention in an embodiment as a normally closed switch and as an opening switch for front side mounting. The contact element comprises a casing 2, two fixed contacts 4 with connections for external electrical conductors and a tappet arrangement 6.

The casing 2 is furnished with clamping elements disposed substantially parallel to a direction of motion of the electrical tappet arrangement 20, but disposed remote from the tappet arrangement 6 on the sides of the casing 2 for positioning the contact element in an appropriate casing support.

Figure 2:
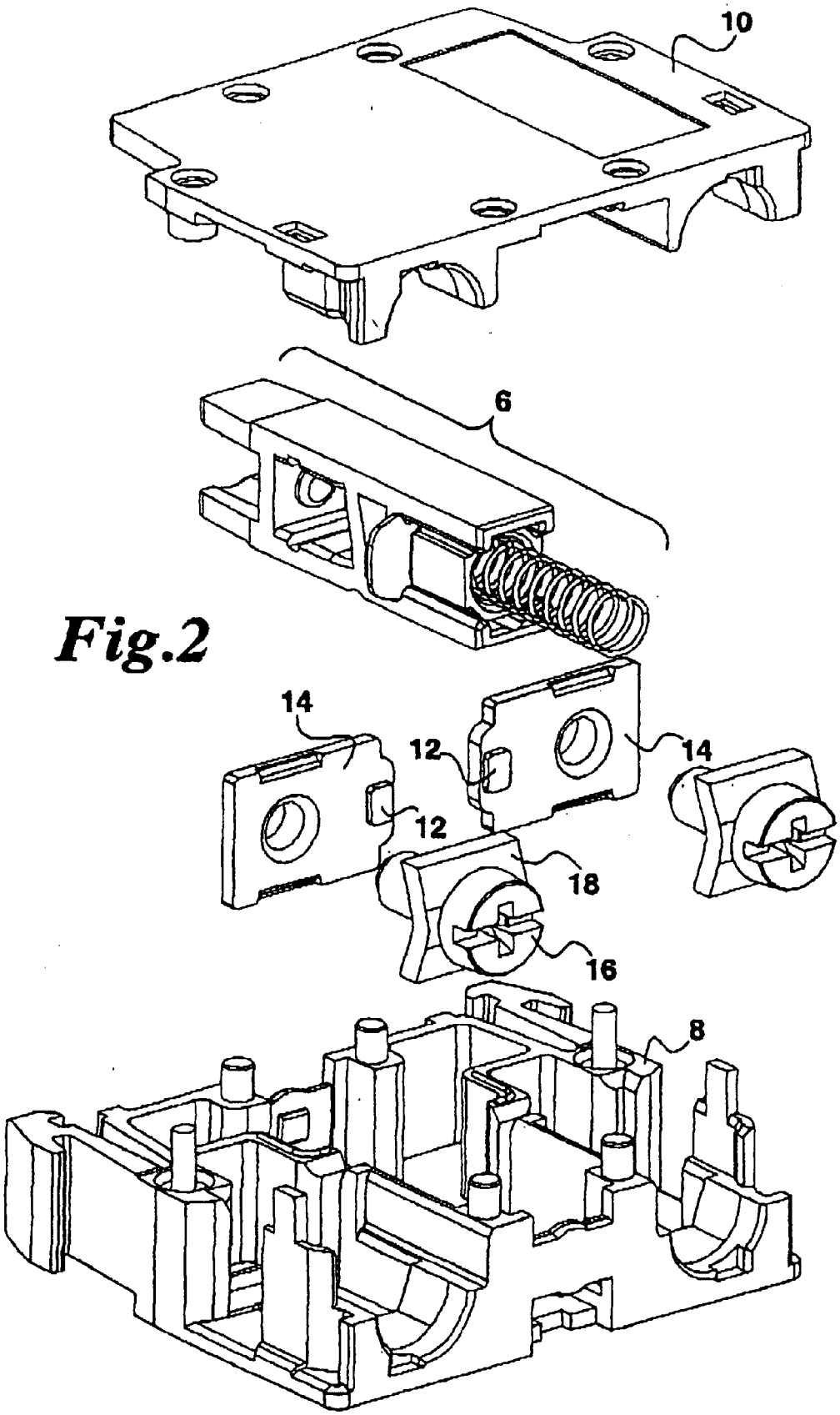
FIG. 2 shows an exploded view of the contact element according to FIG. 1.

Advantageously the casing 2 is constructed of two parts, that is comprising a base part 8 carrying the plunger or tappet arrangement 6 and the fixed contacts 4 and a cover part 10 as shown in FIG. 2.

Each fixed contact 4 here has the shape of screw connections as shown in FIG. 2 comprising a contact plate 14 carrying a contact piece 12, a clamping screw 16, and a pressure plate 18 for clampingly receiving of external conductor connections. The plane of the flat contact plate 14 extends in a plane disposed substantially perpendicular to the direction of motion of the tappet arrangement 6. Preferably a separate contact plate 14 is employed for each contact piece 12. The contact plates 14 leave a center opening in their assembled position to allow passage of the tappet arrangement in their middle. The contact pieces 12 are disposed closely spaced to the middle opening between the two contact plates 14. Tensioning spring clamps or other connection kinds are also employable instead of the screw connections.

Figure 3:
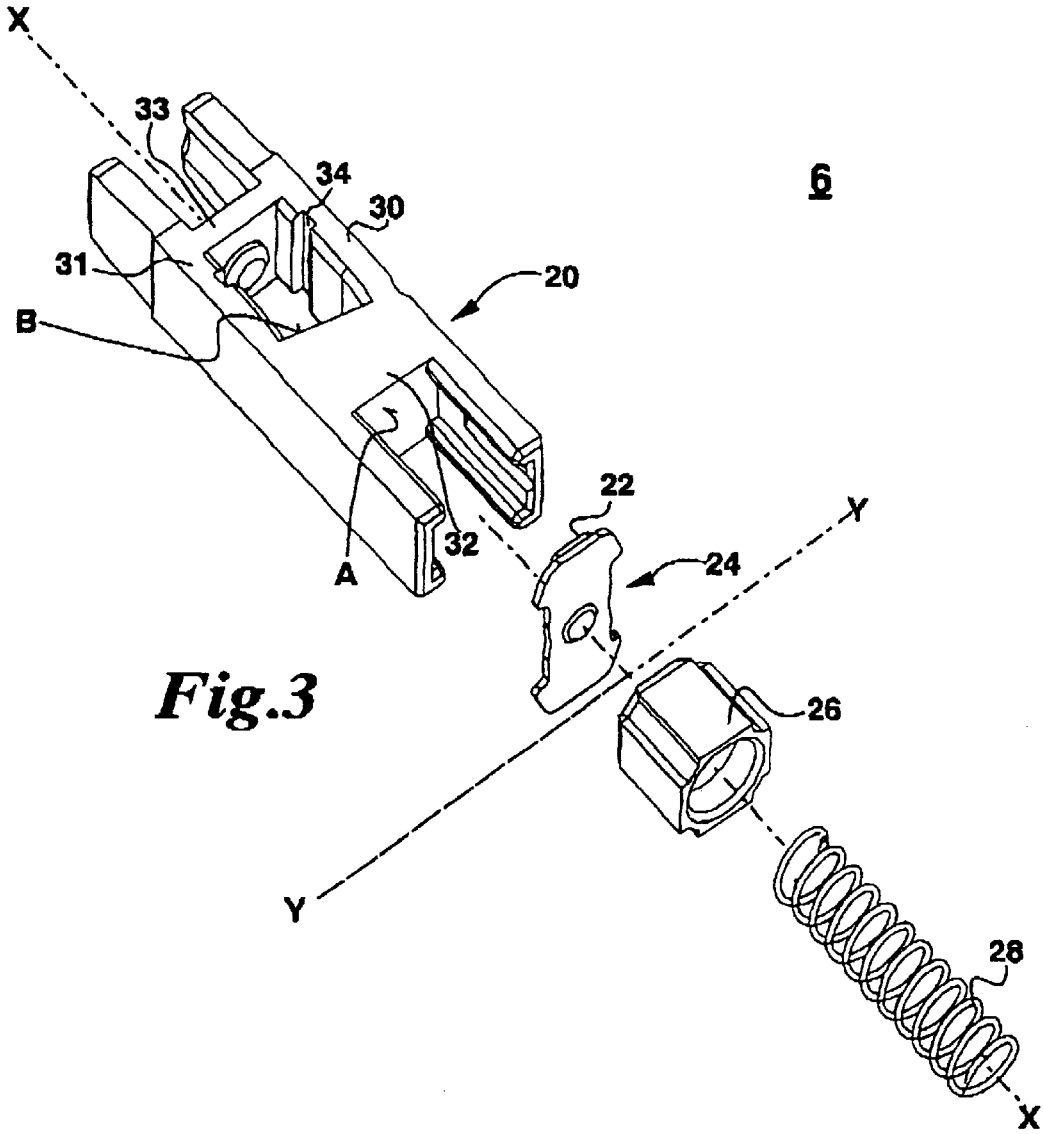
FIG. 3 shows a perspective detailed view of the tappet arrangement of the contact element according to FIGS. 1 and 2.
Figure 4:
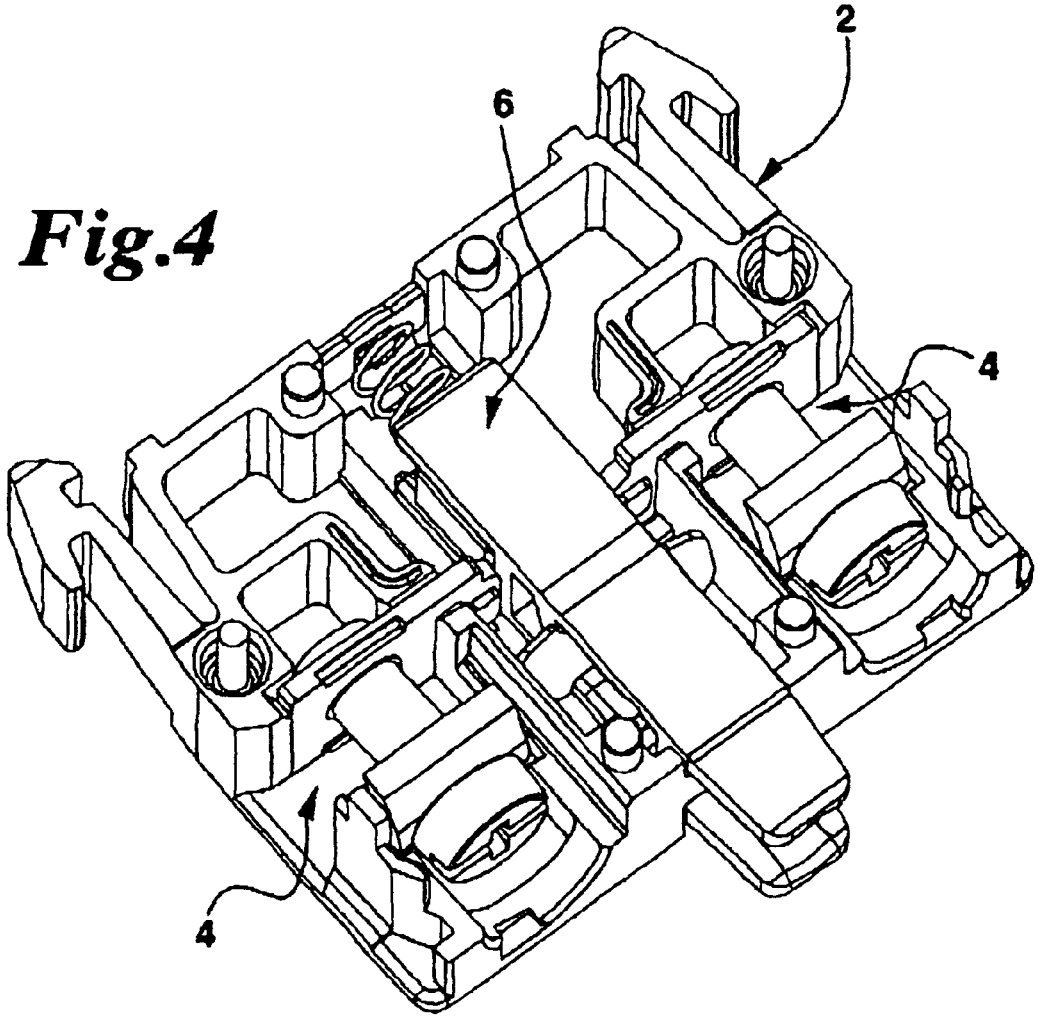
FIG. 4 shows a perspective view of the contact element without cover part as a closing switch for the rearside mounting.
Figure 5:
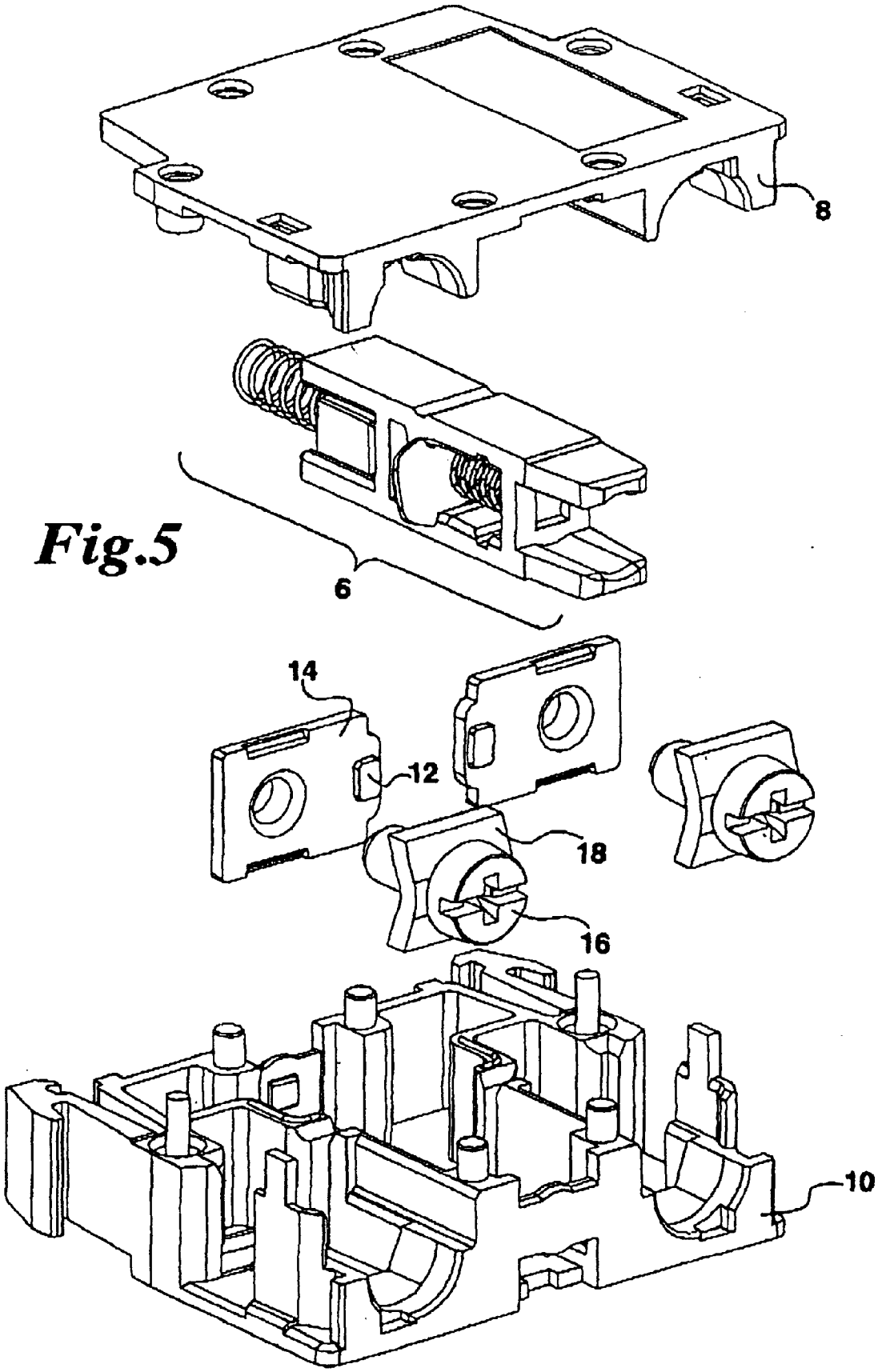
FIG. 5 shows an explodee view of the coltact element according to FIG. 4.
Figure 6:
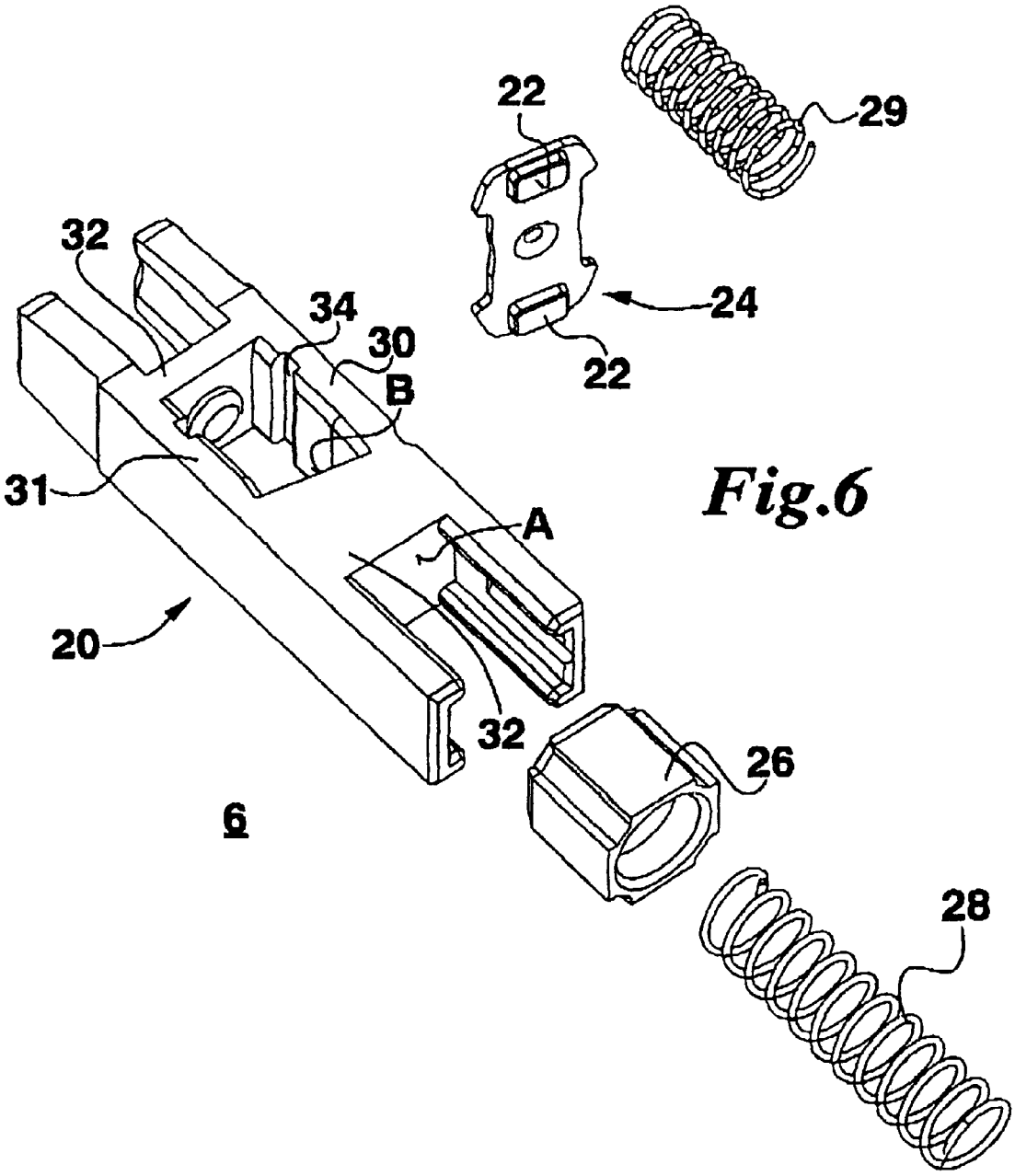
FIG. 6 shows a perspective view of the tappet arrangement of the contact element accordimg to FIGS. 4 and 5.

The tappet arrangement 6 as shown in FIG. 3 comprises an actuating tappet 20, a contact bridge 24 carrying two contact pieces 22, a foot part 26 preferably comprising an isolating material, and spring means 28, 29. The tappet arrangement 6 is constructed according to the present invention such that the contact bridge 24 can be disposed in two different positions having an axial distance from each other at the actuating tappet 20. A first position is the position A, wherein the actuating tappet 20 is formed as an opening tappet as shown in FIGS. 1 through 3 and a second position is the position B, wherein the actuating tappet 20 is formed as a closing tappet as shown in FIGS. 4 through 6. The actuating tappet 20 is disposed in a normally closed position according to FIGS. 1 through 3 and in a normally open position as shown in FIGS. 4 through 6. The contact bridge 24 has two contacts disposed on one face of the contact bridge 24, wherein said contact bridge is extending in a plane disposed perpendicular to the motion direction of the actuating tappet 20. The contact pieces 22 are disposed sideways relative to the structure of the actuating tappet 20 for being capable of engaging a respective one of the contact pieces 12. Preferably, a perpendicular arm part 32 is furnished on the actuating tappet 20, such that the contact bridge 24 can rest against a front plane and a rear plane of the perpendicular arm part 32 as desired. The position of the contact bridge 24 relative to the perpendicular arm part 32 is always such that the contact pieces 22 face the perpendicular arm part 32.

The foot part 26 electrically isolating the contact bridge 24 in the first position A against the spring means 28 is essentially formed square, or rectangular and exhibits a sack hole shaped recess on its side disposed toward the spring 28 for receiving the spring 28. The four virtual edges of the foot part 26 extending in longitudinal direction are formed as grooves, which cooperate with inwardly directed projections of the longitudinal arm parts 30, 31 for purposes of guiding. The foot part 26 is constructed such that it can be mounted in all four rotated positions relative to a longitudinal axis of the actuating tappet 20, whereby additionally a further simplification of assembly is accomplished. The foot part 26 exhibits a fixation recess on the side disposed toward the contact bridge 24, wherein the fixation recess cooperates with a protrusion of the contact bridge 24 for purposes of fixation of the contact bridge 24. The foot part 26 can be formed such as to match the shape of the side of the contact bridge 24 disposed remote relative to the perpendicular arm part 32.

According to a preferred embodiment of the invention the actuating tappet 20 is formed as a plastic injection molding part, which exhibits a double H shape as seen in a longitudinal section and which is formed of longitudinal arm parts 30, 31 and out of two perpendicular arm parts 32, 33, wherein the two oppositely disposed faces of the perpendicular arm part 32 define the positions A and B and form in each case a rest face for the contact bridge 24 in the respective opening position or, respectively, closing position. The perpendicular arm part 32 is disposed such between the longitudinal arm parts, that the longitudinal axis X of the tappet arrangement 6 forms a perpendicular line onto at least one of the rest and support faces of the perpendicular arm part 32. According to another embodiment the rest face or the rest faces can also be formed inclinedly falling or inclinedly rising from one longitudinal arm part 30, 31 to the oppositely disposed longitudinal arm part 31, 30 as shown in FIG. 3. The contact bridge 24 and the contact pieces 22 then have to be formed corresponding to the recited inclination. A self-cleaning of the contact pieces 12, 22 during their cooperation and co-action is accomplished thereby.

The contact bridge 24 can be disposed in the position A between the free ends of the longitudinal arm parts 30, 31 according to the embodiment of FIGS. 1 through 3 and the contact bridge 24 is supported in the assembled state at the casing 2 through the first spring means 28. The spring means 28 serves here as a restoring spring for the tappet arrangement 6 and simultaneously as a contact pressure spring for the contact bridge 24.

The contact element according to FIGS. 1 through 3 is furnished for front side assembly based on its construction. The contact element is also suitable for rearside mounting based on a different assembly of the same construction parts. For this purpose and starting with the illustrated arrangement of the construction parts, the complete tappet arrangement 6 is rotated by 180 degrees around the perpendicular axis Y relative to the longitudinal axis of the tappet, such that the spring element 28 is supported at the oppositely disposed casing wall recognizable in FIG. 4, but not illustrated in detail here. Advantageously also the basis part 8 of the casing 2 is adapted by way of construction to the actuating tappet 20. For this purpose the basis part 8 exhibits at its oppositely disposed front faces running perpendicular to the direction of motion of the actuating tappet 20 in each case pairwise disposed openings for feeding through of the free ends of the actuating tappet 20. The basis part 8 further includes guide elements for allowing the actuating tappet 20 to slide in the basis part 8. The openings at the one casing front side serve for feeding through of the free ends of the actuating tappet 20 incorporated into the contact element, while the other openings disposed in the oppositely disposed casing front side serve for the feeding through of the free ends of an actuating tappet of a contact element attached in piggyback fashion, such that a simultaneous actuation of the two contact elements becomes possible. If the fixed contacts 4 should not be furnished on two sides with contact pieces 12, then the contact pieces 12 are also to be exchanged against fixed contacts 4 with corresponding contact pieces.

The contact arrangement is illustrated in FIGS. 4 through 6 as a closing contact for the rearside mounting of for example a top hat rail. The contact bridge 24 is disposed on the oppositely disposed face B of the perpendicular arm part 32 in the intermediate space between the two perpendicular arm parts 32, 33 and is supported in the intermediate space at the other perpendicular arm part 33 through the second spring element 29 according to this embodiment. The second spring element becomes necessary for a normally open contact switch, wherein contacts are formed when pressure is applied against the restoring force of the spring means 28. The spring means 28 serves exclusively as a restoring spring according to this embodiment and for this reason also the foot part 26 can be dispensed with. The action of the spring means 28, 29 is directed parallel and coaxial to the longitudinal axis of the actuating tappet 20. The contact pressure onto the contact bridge 24 is assured by the additional spring means 29.

At least one groove 34 formed on the inner side of the longitudinal arm part 30 and preferably extending perpendicular to the longitudinal axis X exists in order to simplify assembly, whereby the contact bridge 24 can be introduced into the intermediate space without having to be rotated.

The ends of the actuating tappet 20 are preferably formed for reliably accepting alternatively either a push button or the spring 28 through the foot part 26. The axial length of the casing 2 in parallel to the axis of the actuating tappet 20 substantially can correspond to the total length of the actuating tappet 20. This allows a compact construction of the contact element.

An electrical instruction apparatus such as a pressure switch or a rotary switch or the like can be constructed, wherein a contact element according to the present invention is connected to the instruction apparatus and is employed for switching purposes.

A power switching apparatus such as a power switch, a circuit breaker and the like can have a contact element according to the present invention attached, wherein a contact element allows switching on and off the power switching apparatus.

The present invention is not limited to the embodiments described above but comprises also all embodiments operating in the same way in the sense of the present invention.

It will be understood that each of the elements described above, or two or more together, may also find a useful application in other types of switching system configurations and plunger procedures differing from the types described above.

While the invention has been illustrated and described as embodied in the context of a contact element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A contact element for an electrical switching apparatus comprising a basis part;

a cover part, wherein the basis part and the cover part together form a casing;

a first electrical fixedly disposed contact having connections for electrical conductors and disposed inside of the casing;

a second electrical fixedly disposed contact having connections for electrical conductors and disposed inside of the casing;

a first spring means restrained by and resting against the basis part;

a contact bridge; and an actuating tappet springingly supported by the first spring means in the casing and movable in an axial direction for receiving the contact bridge, wherein the contact bridge serves for connecting or, respectively, interrupting an electrical connection between the first electrical fixedly disposed contact and the second electrical fixedly disposed contact, and wherein the actuating tappet is constructed such that the contact bridge is disposable in two different positions having a distance from each other on the actuating tappet, the actuating tappet being supportable in the casing in two positions so that in the one position the actuating tappet is rotated 180 degrees about a transverse axis of the actuating tappet relative to the other position so as to be operable in opposite axial directions and enable the switching apparatus to be useable for both front side and rear side mounting.

2. The contact element according to claim 1, wherein the actuating tappet exhibits a double H form as seen in a longitudinal section, and comprising a first outer longitudinal arm part and a second outer longitudinal arm part and a first perpendicular arm part and a second perpendicular arm part.

3. The contact element according to claim 2, wherein the two faces of the second perpendicular arm part are disposed opposite to each other and form in each case a support face for the contact bridge.

4. The contact element according to claim 2, wherein at least one of the first longitudinal arm part and the second longitudinal arm part exhibits a groove disposed between the first perpendicular arm part and the second perpendicular arm part for assembly of the contact bridge.

5. The contact element according to claim 2, wherein the second perpendicular arm part is disposed at an inclined angle relative to the a longitudinal direction of the first longitudinal arm part and the second longitudinal arm part.

6. The contact element according to claim 2, wherein the first perpendicular arm part is disposed at an inclined angle relative to the a longitudinal direction of the first longitudinal arm part and the second longitudinal arm part.

7. The contact element according to claim 1, wherein the actuating tappet is constructed mirror symmetrically relative to a plane running in a middle in between the first longitudinal arm part and the second longitudinal arm part.

8. The contact element according to claim 1, wherein the contact bridge is disposable between open ends of the first longitudinal arm part and the second longitudinal arm part and is supportable against the casing through the first spring means placed in a first position, and is disposable between the first perpendicular arm part and the second perpendicular arm part and is supportable against the second perpendicular arm part through a second spring means according to a second position of the first spring means.

9. The contact element according to claim 1, wherein the first spring means is disposed above a foot part comprised of isolating material and positioned between open ends of the first longitudinal arm part and the second longitudinal arm part.

10. The contact element according to claim 1, wherein the casing exhibits in each case pairwise disposed openings for feeding through open ends of the actuating tappet at the front faces of the casing extending in planes disposed perpendicular to the direction of motion of the actuating tappet.

11. The contact element according to claim 1, further comprising an electrical instruction apparatus, wherein the casing is mounted to the electrical instruction apparatus.

12. The contact element according to claim 1, further comprising a power switch, wherein the casing is mounted to the power switch.

* * * * *